US005630284A

United States Patent [19]

Huang

[11] Patent Number: 5,630,284

[45] Date of Patent: May 20, 1997

[54] APPARATUS FOR USE IN WASHING PAINT BRUSHES

[76] Inventor: Chin-Chen Huang, No. 12, 41th Road, Taichung Industrial Park, Taichung City, Taiwan

[21] Appl. No.: 525,151

[22] Filed: Sep. 8, 1995

[51] Int. Cl.[6] ..... F26B 17/30

[52] U.S. Cl. ..... 34/58; 192/109 R

[58] Field of Search ..... 34/58; 366/343, 366/276; 15/65; 192/109 R; 411/191, 196, 197, 221

[56] References Cited

U.S. PATENT DOCUMENTS

| | | | |
|---|---|---|---|
| 2,575,978 | 11/1951 | Scheidecker | 366/343 X |
| 2,884,709 | 5/1959 | Kruger | 34/58 |
| 3,972,512 | 8/1976 | Grise et al. | 366/129 |

FOREIGN PATENT DOCUMENTS

| | | |
|---|---|---|
| 9458894 | 8/1994 | Australia . |
| 684909 | 12/1995 | European Pat. Off. . |
| WO-9416909 | 8/1994 | WIPO . |

*Primary Examiner*—John M. Sollecito
*Assistant Examiner*—Steve Gravini
*Attorney, Agent, or Firm*—Bacon & Thomas

[57] ABSTRACT

An apparatus for use in washing paint brushes, including a cylindrical casing, an inner retainer, an outer retainer, an inner tube, a rectangular transmission plate, a cap, a driving rod, a driven gear, and a coupling block, wherein: the driving rod as a stop arm for securing to the cap as the apparatus is used to drive a paint mixing tool; the coupling block has a coupling hole for holding the handle of the paint mixing tool used.

3 Claims, 6 Drawing Sheets

APPARATUS FOR USE IN WASHING PAINT BRUSHES

BACKGROUND OF THE INVENTION

The present invention relates to apparatus for use in washing paint brushes, and relates more particularly to such an apparatus which can also be used for driving a paint mixing tool.

FIGS. from 1 to 10 show an apparatus for use in washing paint brushes according to the prior art. As illustrated in FIG. 1, the apparatus comprises a cylindrical casing 1, an inner retainer 2, an outer retainer 3, an inner tube 4, a rectangular transmission plate 5, a cap 6, a driving rod 7, a driven gear 8, and a coupling block 9. The cylindrical casing 1, as shown in FIG. 2, has two ball bearings 11 and 12 at two opposite ends, each defining a center through hole 13 or 14. As illustrated in FIG. 3, the inner retainer 2 is made from a metal plate comprising a flat base 23, two curved projections 21 and 22 extended from the border of the flat base 23 at two opposite sides, a circular mouth 24 defined between the front ends of the curved projections 21 and 22, and a center coupling hole 25 at the center of the flat base 23. As illustrated in FIG. 4, the outer retainer 3 is made from a metal plate comprising a flat base 33 two backward projections 31 and 32 respectively extended from the border of the flat base 23 at two opposite sides, a mouth 34 defined between two opposite ends of the backward projections 31 and 32, and a center coupling hole 35 at the center of the flat base 23. As illustrated in FIG. 5, the rectangular transmission plate 5 comprises four triangular teeth 51 outwardly projected from the four corners at the same plane, and a center through hole 52. As illustrated in FIG. 6, the driven gear 8 comprises a coupling portion 82 at one side, an inner thread at the coupling portion 82, and four teeth 83 equiangularly spaced at an opposite side. As illustrated in FIG. 7, the driving rod 7 comprises an auger rod section 71 in the middle, a handle 72 at one end, and a plurality of raised portions 73 at an opposite end. The raised portions 73 are made after the driving rod 7 is inserted through the center through hole 61 of the cap 6 and the center through hole 52 of the rectangular transmission plate 5. Therefore, when the raised portions 73 are made, the cap 6 and the rectangular transmission plate 5 are prohibited from escaping out of the driving rod 7. Referring to FIG. 8, the coupling block 9 has two pins 91 and 92 at two opposite ends. When the inner retainer 2 and the outer retainer 3 are respectively mounted around the pin 92 of the coupling block 9 by the respective coupling holes 25 and 35, the pin 92 is hammered down to form a head, and therefore the inner retainer 2 and the outer retainer 3 are secured to the coupling block 9. When the inner retainer 2 and the outer retainer 3 are fastened to the coupling block 9, the mouths 24 and 34 are aligned. When the pin 91 of the coupling block 9 is welded to the inner tube 4, and therefore the inner retainer 2, the outer retainer 3, the coupling block 9, and the inner tube 4 are fixed together to form a chuck. The inner tube 4 has an outer thread 41 at one end remote from the coupling block 9. Referring to FIGS. 1, 7, and 8 again, steel balls 15 are respectively mounted in the ball bearings 11 and 12 of the cylindrical casing 1, then the chuck (the inner tube 4 with the retainers 2 and 3) is inserted through the center through holes 13 and 14 of the ball bearings 11 and 12, and then the inner thread 81 of the driven gear 8 is threaded onto the outer thread 41 of the inner tube 4, and then the driving rod 7 is inserted into the inner tube 4, permitting the teeth 51 of the rectangular transmission plate 5 to be respectively engaged with the teeth 83 of the driven gear 8, and then the cap 6 is welded to the cylindrical casing 1. When in use, the cylindrical casing 1 is held in one hand, the handle 72 of the driving rod 7 is pulled outwards with the other hand. When the driving rod 7 is pulled out of the cylindrical casing 1, the rectangular transmission plate 5 is driven by the auger rod section 71 of the driving rod 7 to turn the chuck. When the handle 72 of the driving rod 7 is forced backwards to its former position, the chuck is turned in the reversed direction. Referring to FIG. 9, a flat paint brush 10 can be fastened to the mouth 34 of the outer retainer 34 and the mouth 24 of the inner retainer 2. Referring to FIG. 10, a cylindrical paint brush 20 can be mounted around the outer retainer 3. When a paint brush is installed, it is dipped in the solvent, and the chuck is turned back and forth to move the paint brush in the solvent, permitting residual paint to be quickly removed from the paint brush.

SUMMARY OF THE INVENTION

The present invention improves the structure of the aforesaid apparatus. According to one aspect of the present invention, the mouth of the inner retainer is made of hexagonal shape, and the coupling block has a hexagonal plug hole. Therefore, the hexagonal handle of a paint mixing tool can be inserted through the hexagonal mouth of the inner retainer and fitted into the hexagonal plug hole of the coupling block for turning by the apparatus for mixing paint.

According to another aspect of the present invention, the cap has a projecting stop rod, and a retaining hole defined by the projecting stop rod; the driving rod has one end terminating in a loop-like handle and a stop arm at one side of the loop-like handle, the stop arm having a recessed retaining hole for engagement with the retaining hole of the cap for permitting the driving rod to be locked in position. Therefore, the apparatus can be hung on a support through the loop-like handle.

DETAILED DESCRIPTION OF THE PREFERRED EMBODIMENT

The present invention improves the structure of the prior art apparatus shown in FIGS. from 1 to 10.

Figure 11A:
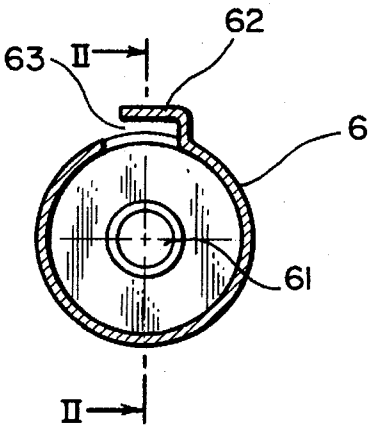
FIG. 11A is a cross-sectional view of the cap according to the present invention taken along line III—III of FIG. 11B.
Figure 11B:
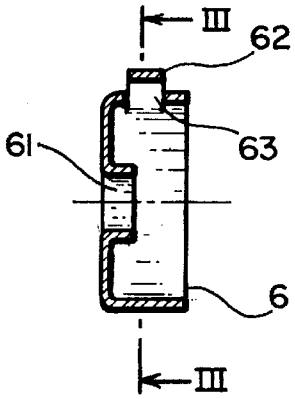
FIG. 11B is a cross-sectional view long line II—II of FIG. 11A.

Referring to FIG. 11, the cap 6 has a projecting stop rod 62, and a retaining hole 63 defined by the projecting stop rod 62.

Figure 1:
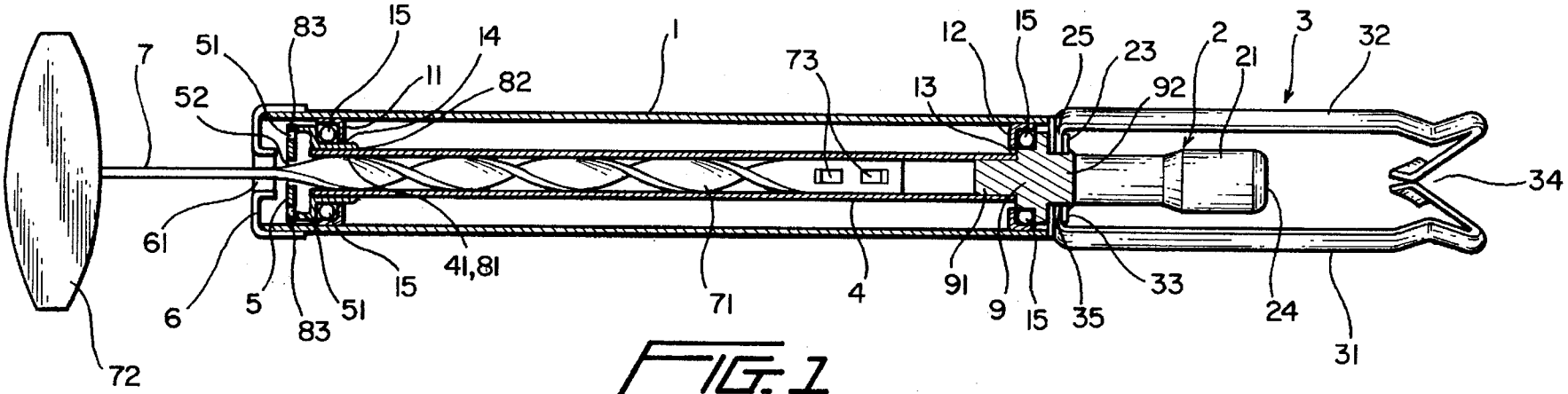
FIG. 1 (PRIOR ART)
FIG. 1 is a sectional view of an apparatus for use in washing paint brush according to the prior art.
Figure 2:
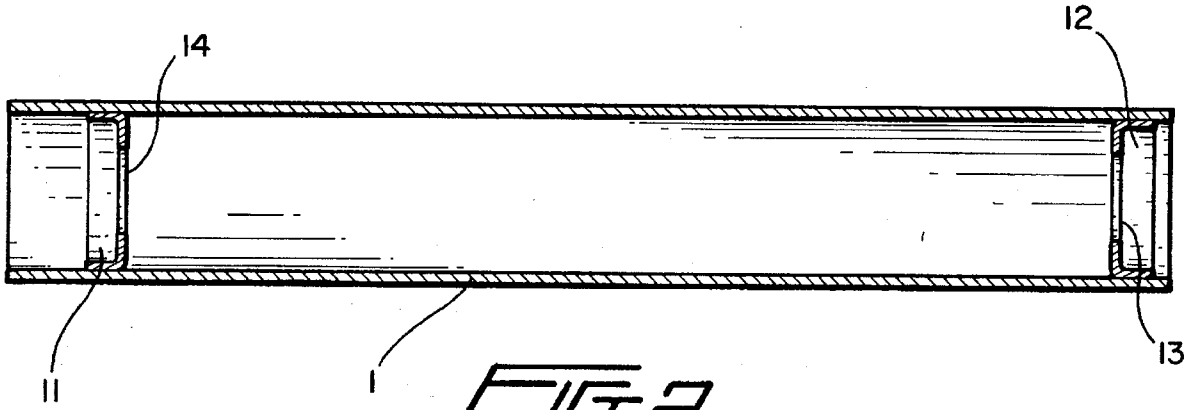
FIG. 2 (PRIOR ART)
FIG. 2 is a longitudinal view in section of the cylindrical casing shown in FIG. 1.
Figures 3A, 3B, 3C, 3D, 4A, 4B, 4C, 5, 6A, 6B:
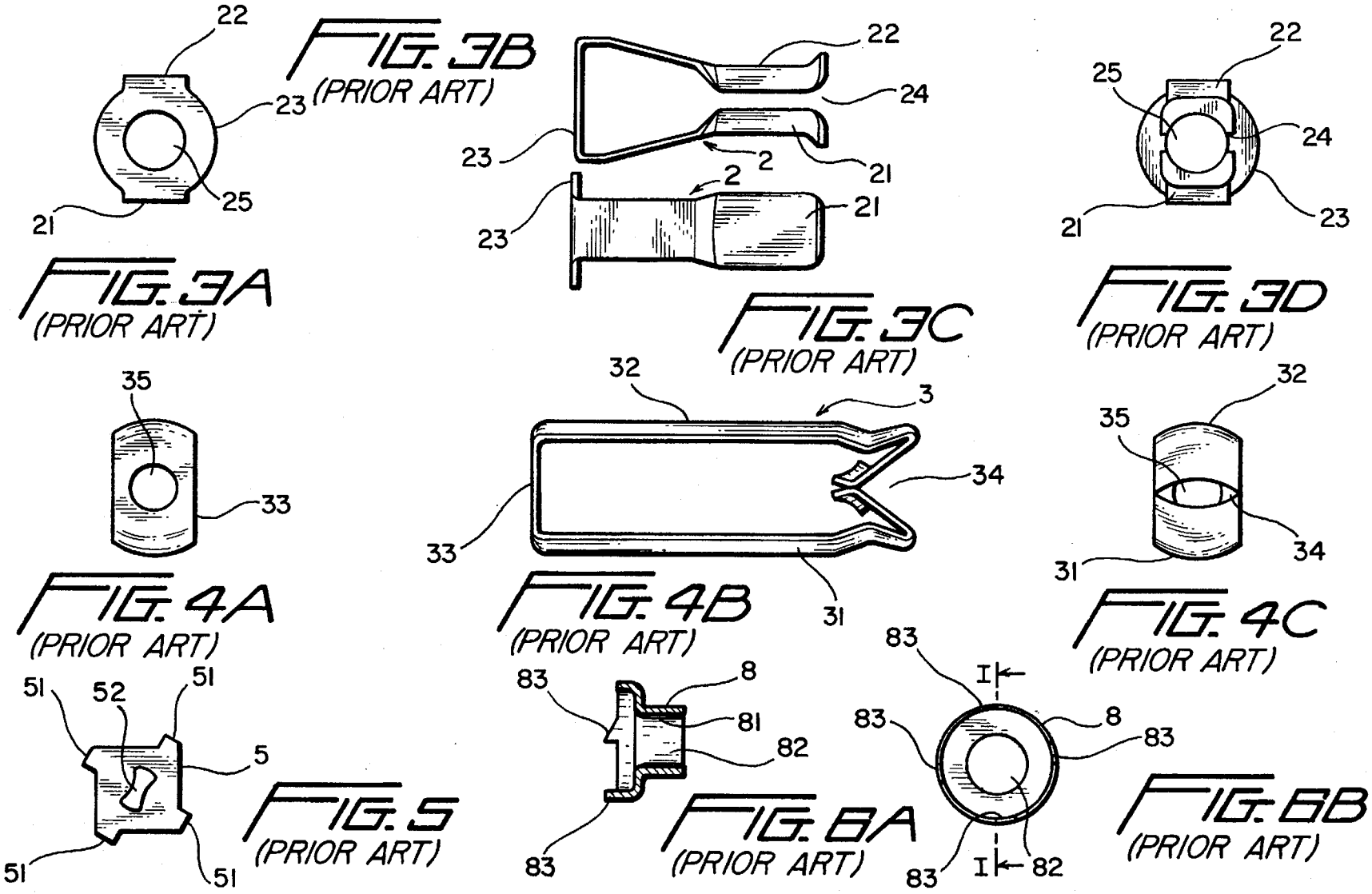
FIG. 3A (PRIOR ART)
FIG. 3B (PRIOR ART)
FIG. 3C (PRIOR ART)
FIG. 3D (PRIOR ART)
FIG. 4A (PRIOR ART)
FIG. 4B (PRIOR ART)
FIG. 4C (PRIOR ART)
FIG. 5 (PRIOR ART)
FIG. 6A (PRIOR ART)
FIG. 6B (PRIOR ART)
FIGS. 3A–3D are front, side, rear and top views, respectively, of the inner retainer shown in FIG. 1.
FIGS. 4A–4C are front, side and rear views, respectively, of the outer retainer shown in FIG. 1.
FIG. 5 is a front view of the rectangular transmission plate shown in FIG. 1.
FIG. 6A is a rear view of the driven gear shown in FIG. 1.
FIG. 6B is a cross-sectional view taken along line I—I in FIG. 6A.
Figure 7:
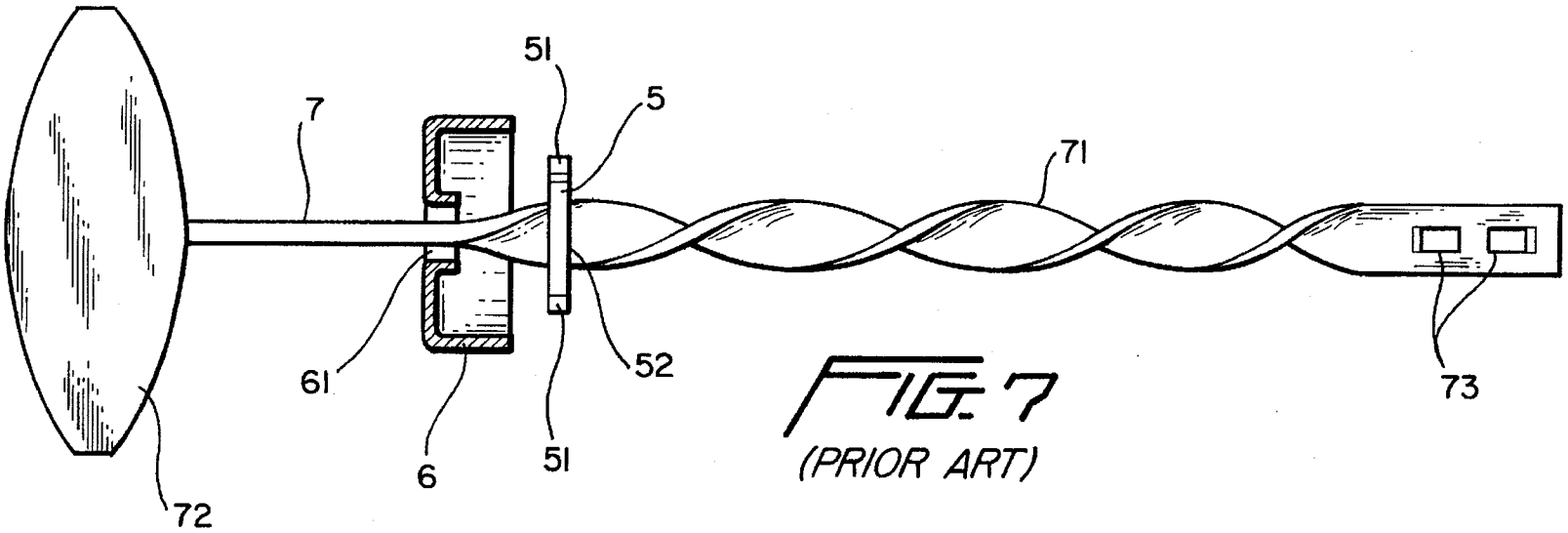
FIG. 7 (PRIOR ART)
FIG. 7 shows the driving rod, cap, and transmission plate of the apparatus of FIG. 1 assembled.
Figure 8:
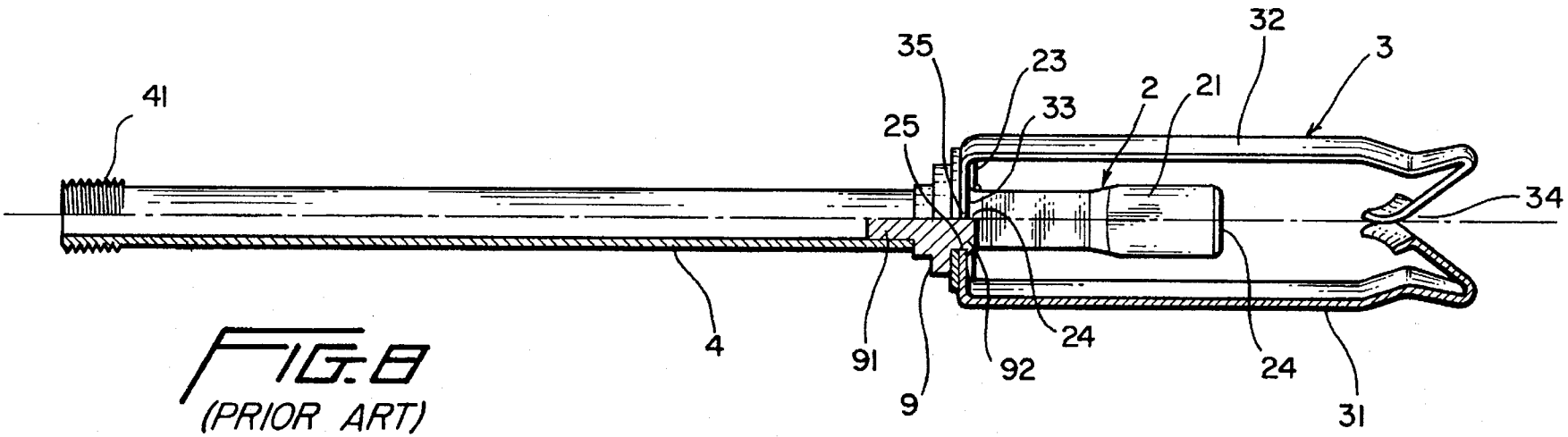
FIG. 8 (PRIOR ART)
FIG. 8 shows the inner retainer, outer retainer, coupling block, and inner tube of the apparatus of FIG. 1 fastened together.
Figure 9:
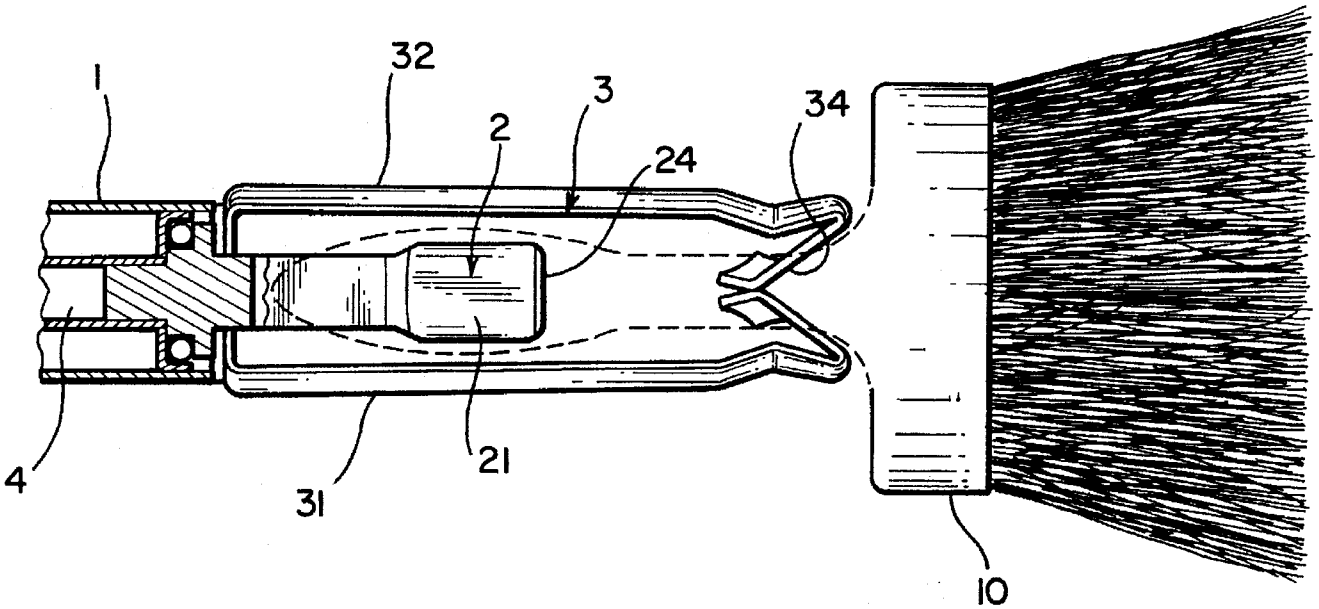
FIG. 9 (PRIOR ART)
FIG. 9 shows a flat paint brush fastened to the chuck of the apparatus of FIG. 1.
Figure 10:
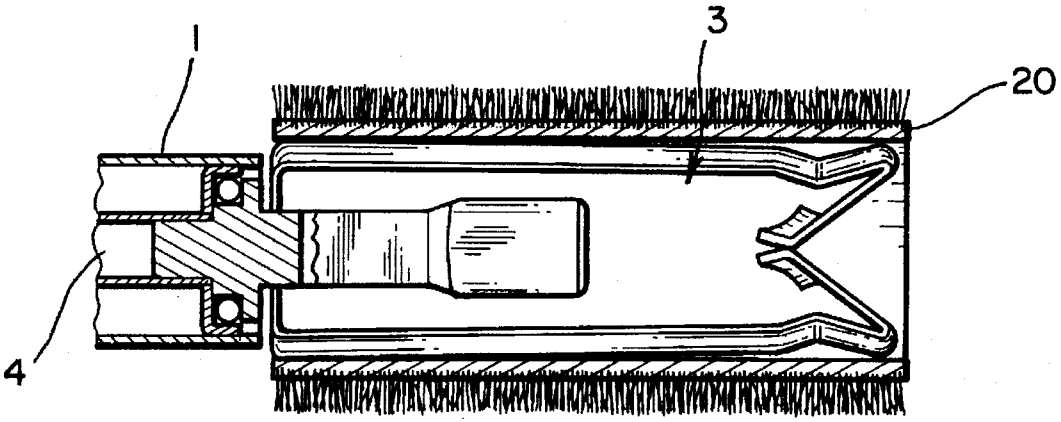
FIG. 10 (PRIOR ART)
FIG. 10 shows a cylindrical paint brush fastened to the chuck of the apparatus of FIG. 1.
Figure 12:
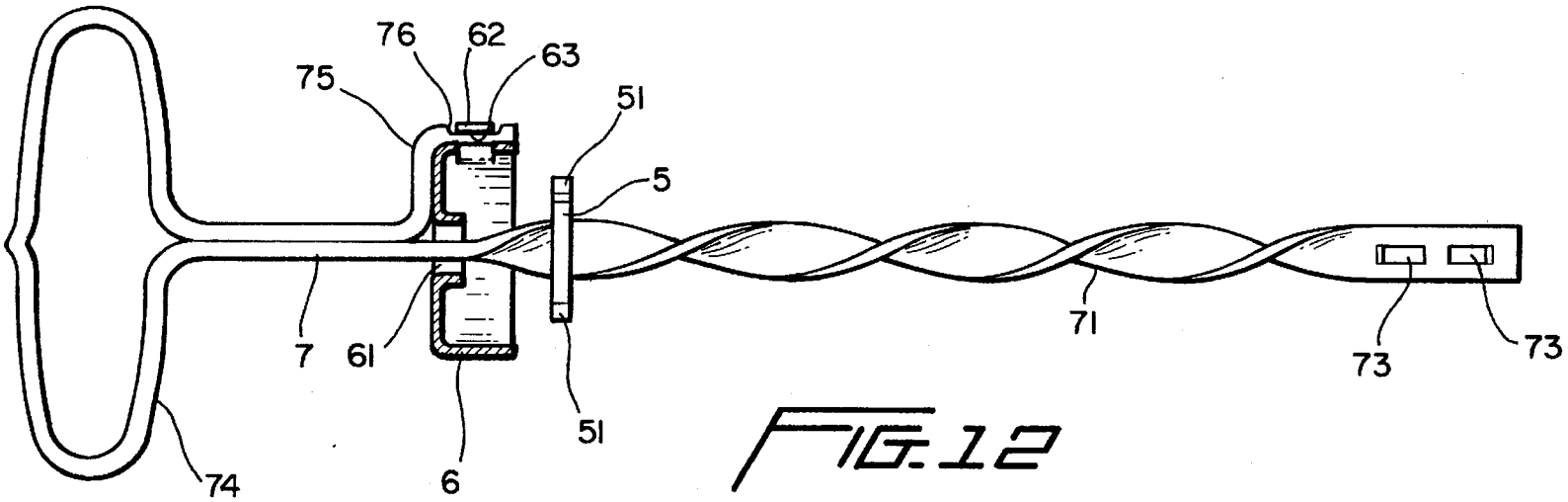
FIG. 12 shows the transmission block and the cap fastened to the driving rod according to the present invention.

Referring to FIG. 12, the driving rod 7 has one end terminating in a loop-like handle 74 and a stop arm 75 at one side of the loop-like handle 74. The stop arm 75 has a recessed retaining hole 76 at an outer side. When the stop arm 75 is attached to the outside wall of the cap 6, it is forced into the retaining hole 63, permitting the the projecting stop rod 62 to engage the recessed retaining hole 76. When the stop arm 75 is retained to the projecting stop rod 62, the driving rod 7 is stopped from axial movement.

Figure 13:
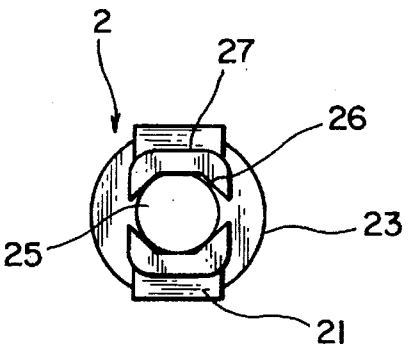
FIG. 13 is a front end view of the inner retainer according to the present invention.

Referring to FIG. 13, the mouth, referenced by 26, which is defined between the front ends of the curved projections 21 and 22 of the inner retainer 2 is a hexagonal mouth.

Referring to FIG. 14, one pin 92 of the coupling block 9 defines a hexagonal plug hole 93 in the axial direction. When the pin 92 is inserted into the coupling holes 25 and 35 of the inner retainer 2 and the outer retainer 3 and then fixed in place, the hexagonal plug hole 93 is alinged with the hexagonal mouth 26 of the inner retainer 2 and the mouth 34 of the outer retainer 3.

Figures 14A, 14B, 15, 16, 17:
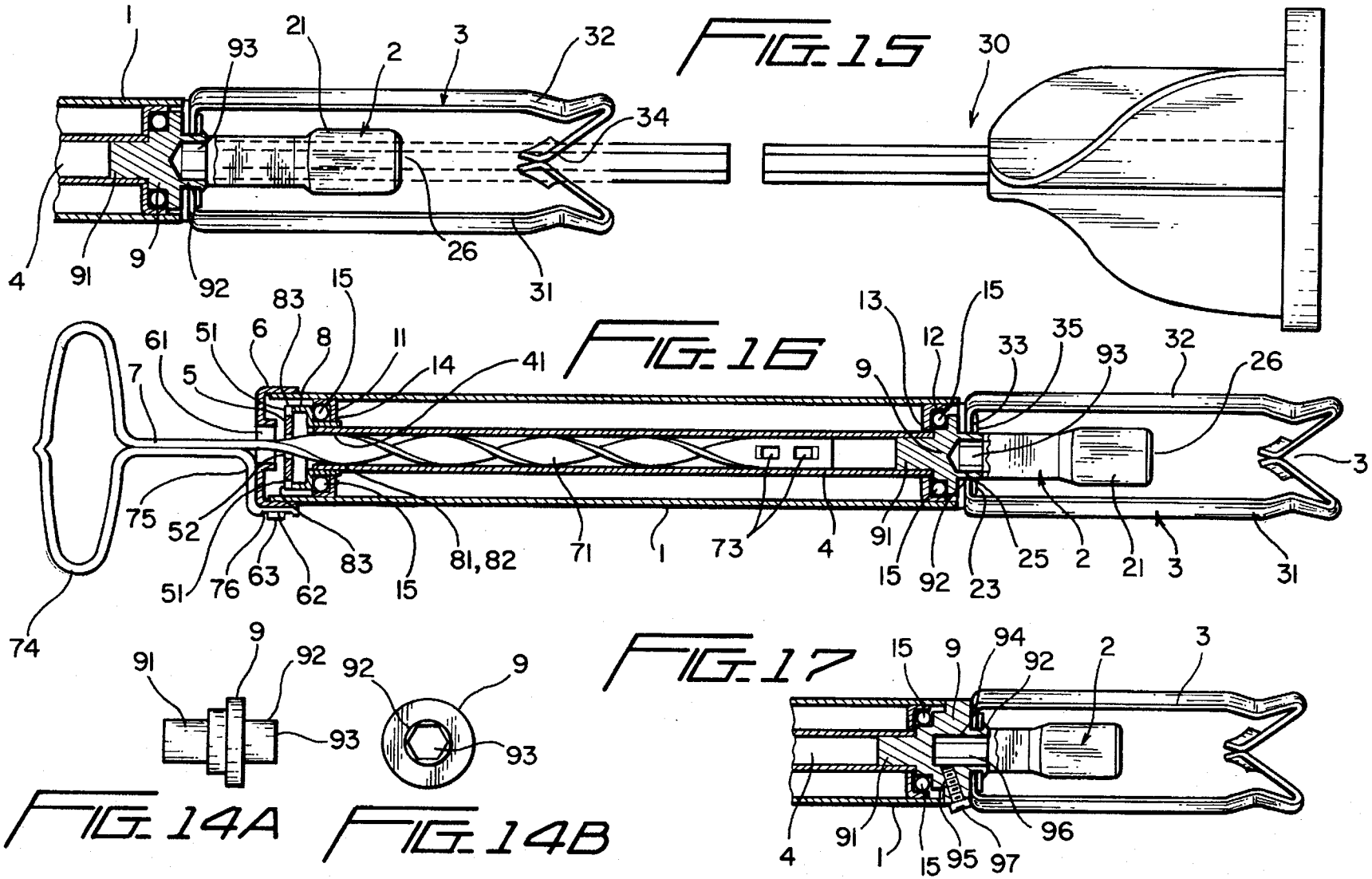
FIGS. 14A, 14B are side and rear views, respectively, of the coupling block according to the present invention.
FIG. 15 shows a paint mixing tool fastened to the apparatus according to the present invention.
FIG. 16 is a longitudinal assembly view in section of the apparatus according to the present invention.
FIG. 17 shows an alternate form of the present invention.

Referring to FIG. 15, the hexagonal handle of a mixing tool 30 can be inserted through the mouth 34 of the outer retainer 3 and the hexagonal mouth 26 of the inner retainer 2 into the hexagonal plug 93 of the coupling block 9, and therefore the mixing tool 30 can be driven by the apparatus to mix paint.

FIG. 17 shows an alternate form of the coupling block 9. As illustrated, the coupling block 9 has an axial coupling hole 94 defined within the pin 92, a radial screw hole 95 connected to the axial coupling hole 94, a socket 96 fastened to the axial coupling hole 94 and fixed in place by a tightening up screw 97, which is threaded into the radial screw hole 95. The socket 96 may be variously shaped subject to the cross section of the handle of the mixing tool 30.

I claim:

1. An apparatus for use in working paint brushes comprising:

a) a cylindrical casing;

b) an inner tube rotatably mounted within the cylindrical casing so as to rotate with respect to the cylindrical casing;

c) a driving rod having a spiral portion extending into the inner tube and a handle portion located exteriorly of the cylindrical casing;

d) a transmission plate connected with the inner tube and engaging the spiral portion of the driving rod such that axial movement of the driving rod relative to the cylindrical casing causes rotation of the inner tube;

e) a cap on the cylindrical casing, the driving rod passing through the cap;

f) a projecting stop rod extending from the cap;

g) a stop arm extending from the driving rod, the stop arm having a recessed portion releasably engageable with the projecting stop rod so as to releasably prevent relative axial motion between the driving rod and the cylindrical casing;

h) an outer retainer connected to the inner tube so as to rotate therewith; and, i) an inner retainer connected to the inner tube so as to rotate therewith.

2. The apparatus of claim 1 wherein said inner retainer has a hexagonal mouth and further comprising a coupling block connected to the inner retainer and having a hexagonal plug hole axially aligned with the hexagonal mouth of said inner retainer for holding a handle of a paint mixing tool.

3. The apparatus of claim 2 wherein said coupling block further comprises; an axial coupling hole; a radial screw hole communicating with said axial coupling hole; a socket fastened to said coupling in said axial coupling hole for holding the handle of a paint mixing tool; and a tightening up screw threaded into said radial screw hole to hold down said socket.

* * * * *